United States Patent [19]

Childs, Jr. et al.

[11] Patent Number: 4,785,869

[45] Date of Patent: Nov. 22, 1988

[54] METHOD OF SIZING A HOT TOP LINER AND ASSEMBLING A HOT TOP

[75] Inventors: Charles B. Childs, Jr., Marietta, Ga.; Enn Vallak, Geneva, Switzerland; Hannes Vallak, Grythyttan, Sweden

[73] Assignees: Re-Top USA, Inc., Arlington, Va. ; by said Charles B. Childs, Jr.; Re-Top International Limited, St. Helier, Channel Islands; by said Enn Vallak and Hannes Vallak

[21] Appl. No.: 143,725

[22] Filed: Jan. 14, 1988

Related U.S. Application Data

[62] Division of Ser. No. 918,314, Oct. 14, 1986, Pat. No. 4,721,278.

[51] Int. Cl.[4] ..... B22D 7/10

[52] U.S. Cl. ..... 164/4.1; 164/137

[58] Field of Search ..... 164/4.1, 457, 137, 123

[56] References Cited

U.S. PATENT DOCUMENTS 3,274,652 9/1966 Banks ..... 164/4.1

*Primary Examiner*—Nicholas P. Godici

*Assistant Examiner*—J. Reed Batten, Jr.

*Attorney, Agent, or Firm*—Shlesinger, Arkwright & Garvey

[57] ABSTRACT

The free energy of a metal which will fill the sinkhead of an ingot mold is calculated by assuming the dimensions of a liner sized to achieve the selected sinkhead volume and calculating the maximum temperature which the liner would achieve upon filling the sinkhead with a molten metal. The free energy is maximized until the mass of the liner is minimized at a calculated temperature less than the melting temperature of the liner. A liner is formed having dimensions corresponding to those of the calculated minimum mass liner. The liner is inserted into a support structure which will rest on the ingot mold.

19 Claims, 5 Drawing Sheets

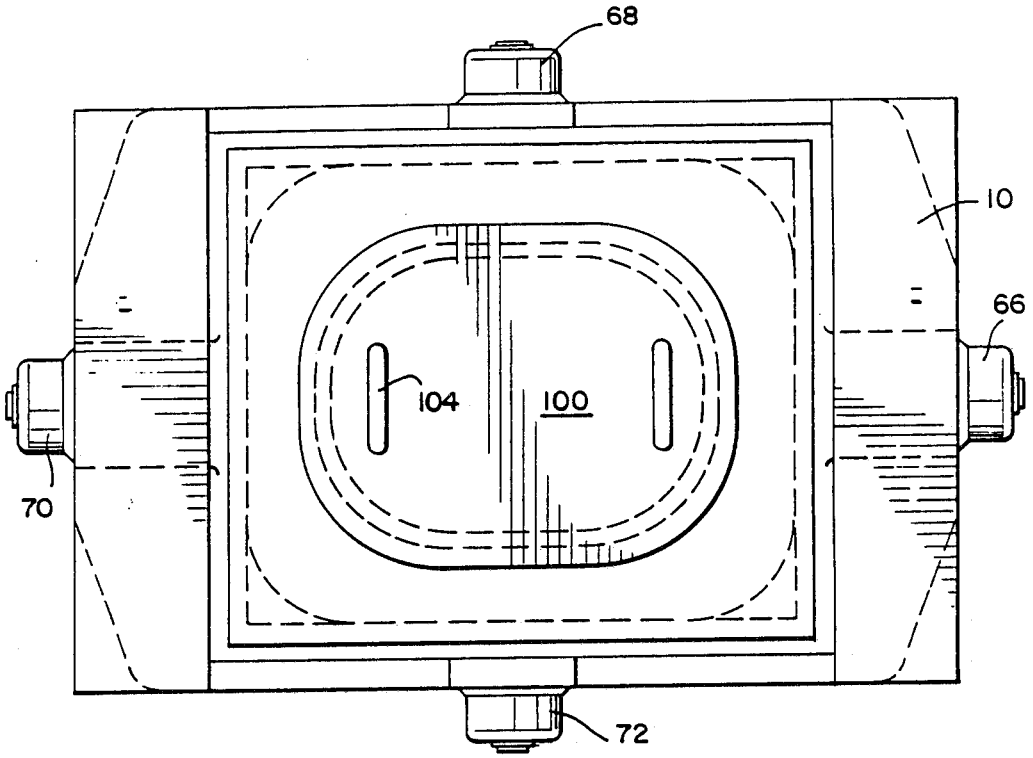
FIG 4
FIG 5
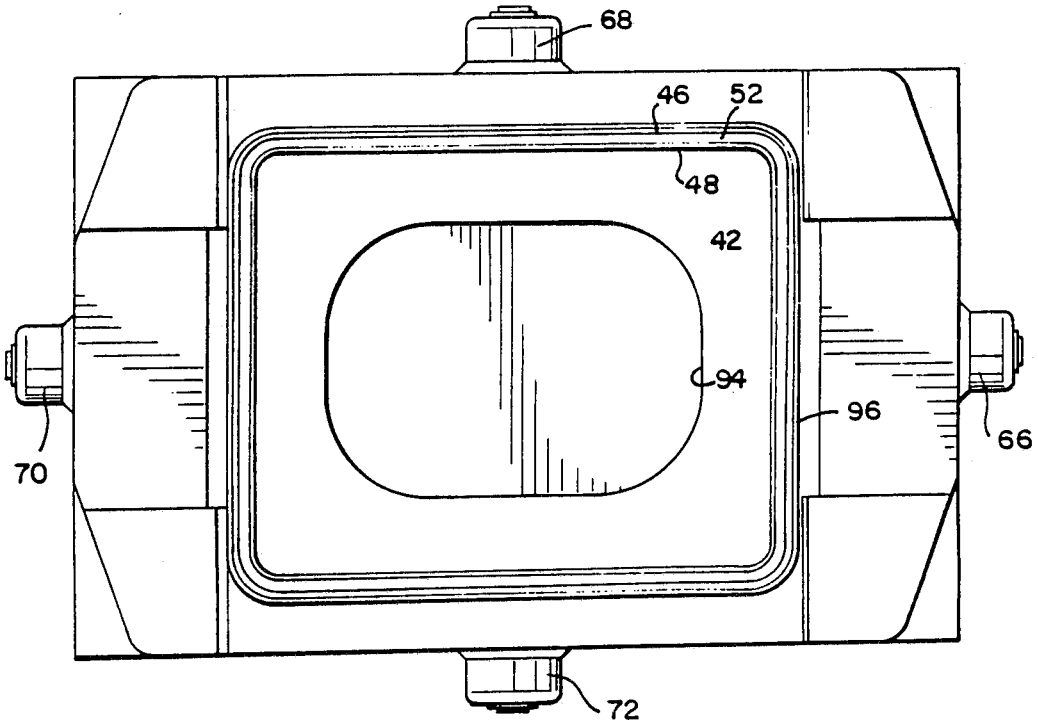

FIG 6
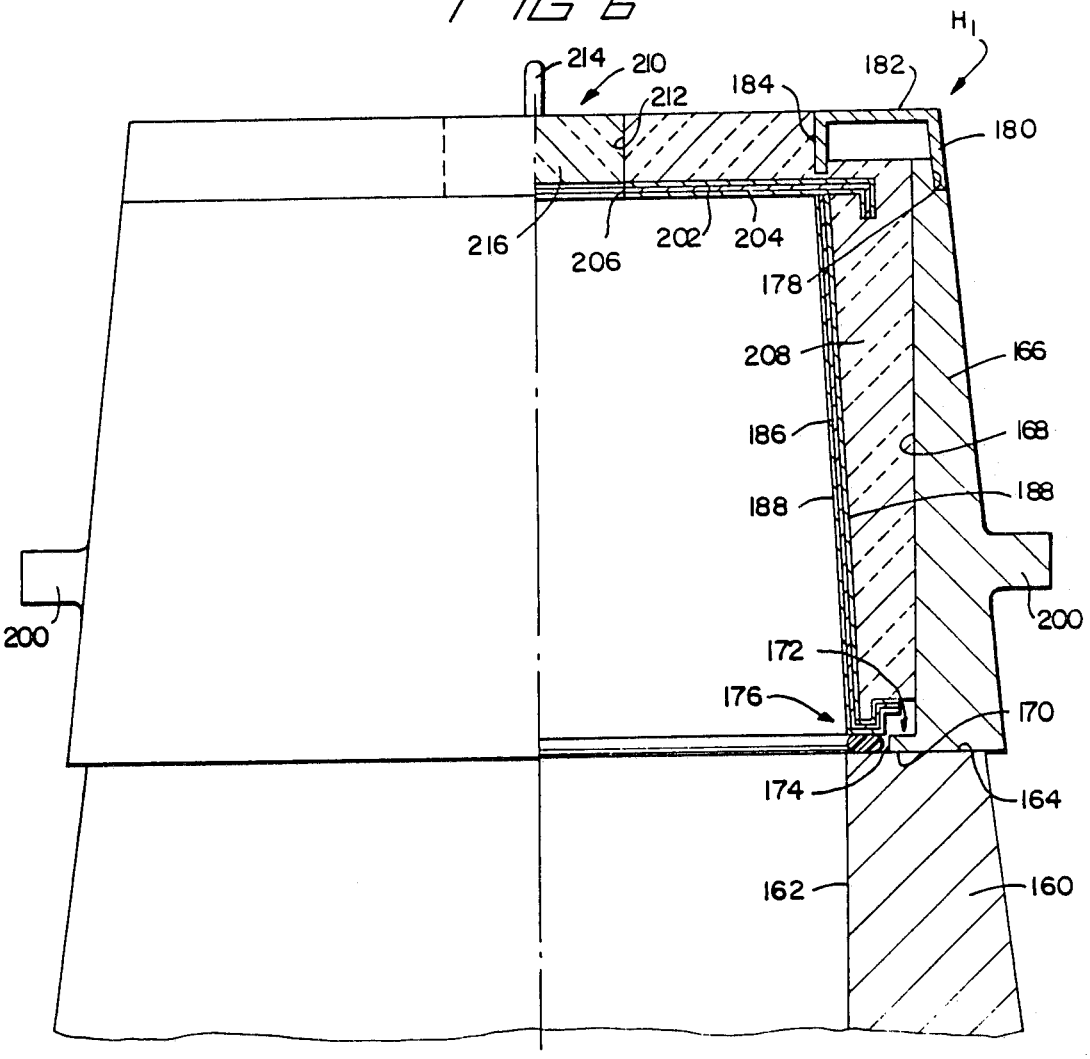
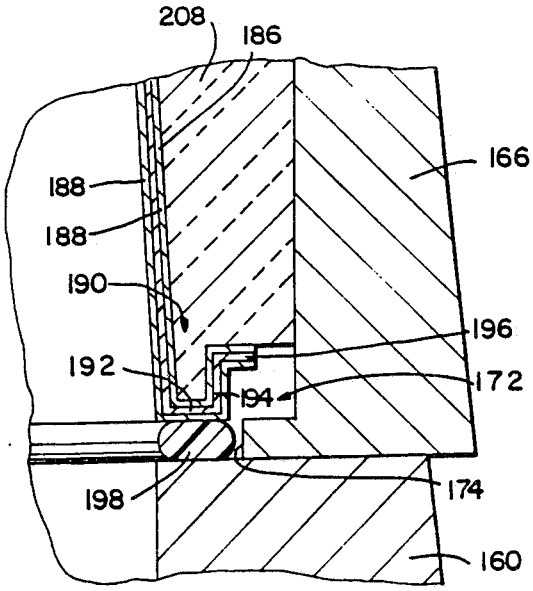
FIG 7

METHOD OF SIZING A HOT TOP LINER AND ASSEMBLING A HOT TOP

This is a division of application Ser. No. 918,314, filed Oct. 4, 1986 and now U.S. Pat. No. 4,721,278 issued Jan. 26, 1988.

BACKGROUND OF THE INVENTION

Conventional production techniques for iron, steel and other similar metals involves the pouring of molten metal into an ingot mold in which the metal is chilled to form an ingot which is thereafter further processed. The ingot mold is usually a large cast iron body having an opening therein in which the molten metal is received. Typically, a hot top, of either the combustible or the non-combustible type, is placed upon the mold prior to pouring and provides a reservoir of molten metal which substantially eliminates the problem of pipe formation. Those skilled in the art understand that the chilling of the metal in the relatively cold mold can cause a central void to form in the chilled metal because the specific volume of the metal is greater at the casting temperature than at the chilling temperature.

The hot top serves as a reservoir for molten metal which fills this void and thereby assures that the resulting ingot is substantially void free. It is therefore important that the hot top either provide sufficient heat or prevent heat conductance and thereby loss so that the metal in the reservoir, or the sinkhead as it is known, will not itself chill and therefore be unavailable for preventing pipe formation.

Non-combustible hot tops are designed to be reusable and to provide substantial insulation for the sinkhead in order to prevent premature chilling of the metal in the reservoir. Typically, the hot tops have been large and heavy an thereby cumbersome to use. It is known to move the hot top off the sinkhead after a thin metal shell has formed in order to provide an air gap which provides additional insulation and also prevents the metal from adhering to the hot top.

These conventional non-combustible hot tops may also cause the metal in the sinkhead to be chilled more than is desired because of the mass of the hot top. Naturally, the molten metal in the sinkhead will heat the surrounding walls of the hot top so that heat is therefore lost. Typically, the surrounding hot top may cause the sinkhead to be chilled to a thickness of as much as six times the thickness of the hot top. Those skilled in the art will appreciate that it is desirable to minimize to the maximum extent possible the chilling of the metal in the sinkhead due to heating of the hot top so that more molten metal will be available for preventing pipe formation.

Furthermore, the hot top is typically placed into contact with the cast iron mold by being seated thereon. Both the hot top and the mold are formed of heat absorbing material. Because the hot top is of much less mass than is the mold, there is a natural tendency for the mold to act as a radiator so that the heat in the sinkhead is drained away to the mold and thereby the chilling increased as the mold is heated.

OBJECTS AND SUMMARY OF THE INVENTION

The primary object of the disclosed invention is to provide a lightweight reusable hot top having a liner which is thermally isolated from the hot top and the mold so that chilling of the metal in the sinkhead is substantially prevented.

The disclosed invention is a reusable hot top comprising a heavy exterior shell having an aperture therethrough providing an inner wall. The shell has an upper end portion and a lower end portion which seats on the upper end of the mold. A stainless steel liner is positioned in the aperture and is spaced from the inner wall and is axially movable within the aperture. Insulation is sandwiched between the liner and the inner wall for preventing heat conductance therebetween. A plurality of pins extend from the inner wall and semicircular lugs extend from the liner. The pins are received in the lugs when the shell is lifted so that the liner cannot fall from the aperture and the pins disengage from the lugs when the shell is seated on the mold so that no heat is conducted from the liner to the shell through the pins. A thermal seal extends around the bottom of the liner and supports the liner atop the mold so that the liner does not come into contact with the mold so that the mold cannot act as a radiator. Another seal extends around the top of the liner and engages a positioning cap affixed to the shell when the shell is seated on the mold for also thermally isolating the liner from the shell.

Preferably, the liner is comprised of a chromium stainless steel and has a thickness of about 0.06 inches. Both the inner surface and the outer surface of the liner are coated with an anti-wetting insulation material, such as zirconium oxide, in order to further increase the insulating value of the liner. The anti-wetting composition also prevents adherence of the chilling metal to the liner and prevents spalling which may occur upon repeated use of the hot top.

These and other objects and advantages of the invention will be readily apparent in view of the following description and drawings of the above described invention.

DESCRIPTION OF THE DRAWINGS

The above and other objects and advantages and novel features of the present invention will become apparent from the following detailed description of the preferred embodiment of the invention illustrated in the accompanying drawings, wherein:

FIG. 4 is a top plan view of the hot top of FIG. 1;

FIG. 5 is a bottom plan view of the hot top of FIG. 1;

FIG. 6 is a side elevational view partially in section and illustrating a second embodiment of the invention;

FIG. 7 is a fragmentary view thereof disclosing the peripheral seal assembly; and, FIG. 8 illustrates a curve relating yield to available free energy.

DESCRIPTION OF THE INVENTION

Figure 1:
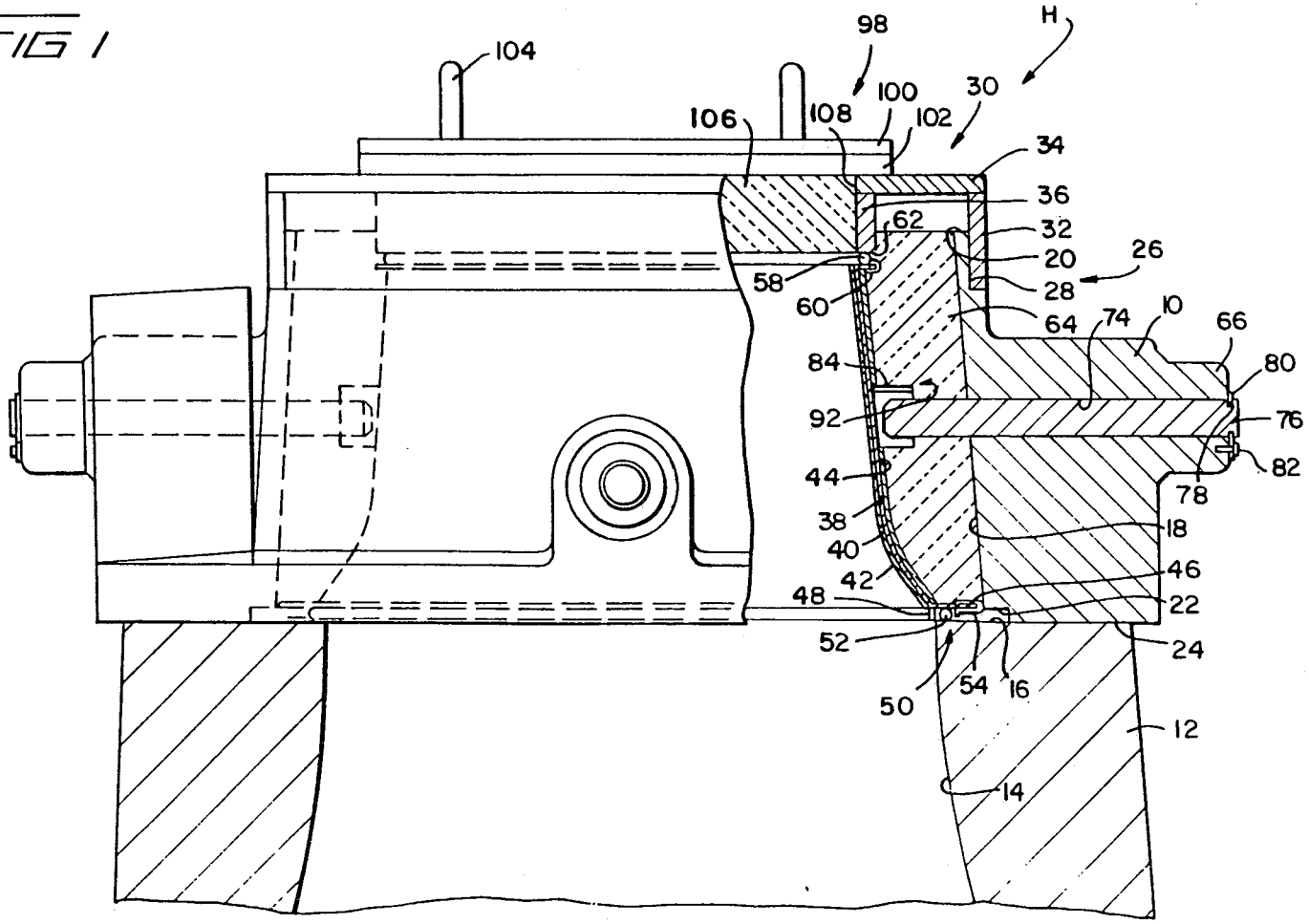
FIG. 1 is an elevational view of the hot top of the invention with portions broken away and shown in section.

Hot top H, as best shown in FIG. 1, includes a shell 10 which is, preferably, a steel casting or forging of substantial weight which rests upon ingot mold 12. Ingot mold 12 has a central opening 14 therein which extends downwardly from upper seating surface 16. The mold 12 is manufactured from cast iron or the like and typically has substantial mass and size, as is known in the art.

Shell 10 has a central opening 18 which extends from upper end 20 to notch 22 adjacent lower mold engaging surface 24 which seats on seating surface 16 of mold 12. Upper end portion 26 has an annular recess 28 and inverted U-shaped cap 30 has the leg 32 thereof secured in recess 28 by welding or the like. Cap 30 also has horizontal member 34 secured to leg 32. Leg 36 extends from the opposite end of member 34 substantially parallel to leg 32 and is disposed in opening 18, for reasons to be explained later. It can be noted that leg 36 has a length less than the length of leg 32. Preferably, cap 30 is also comprised of a heat conductive material, such as steel.

Stainless steel liner 38 is slidably received in opening 18 and is frustoconical in shape and tapers toward upper end 20. Preferably, liner 38 has the inner surface 40 thereof coated with an anti-wetting insulating composition 42. A similar anti-wetting coating composition 42 is applied to outer surface 44 of liner 38.

Preferably, liner 38 is comprised of a chromium containing stainless steel, such as type 310 stainless steel. We have found that chromium stainless steels of the 300 grade have lower thermal conductivity than carbon steel and therefore provide a better thermal insulation barrier. Also, type 310 stainless steel has the highest strength at the steel casting temperature of the stainless steels. Other grades of stainless steel, such as the 400 grade, are too delicate after repeated thermal cycling. The liner 38 has a thickness of, preferably, 0.06 inches with a maximum thickness of no more than 0.3 inches and a minimum thickness of as little as 0.01 inches. The liner 38 is relatively thin as compared to prior art hot tops and therefore less mass is available for absorbing heat from the molten metal in the sinkhead.

While we prefer to use 310 stainless steel, other liner materials may be substituted, providing that the required strength and insulating properties are presented. Among these liner materials are low carbon steel, pig iron, chromium, titanium, zirconium, boron, hafnium, columbium, molybdenum, tantalum, tungsten, graphite and carbon-carbon composites and combinations thereof. It should be clear that the liner material should be selected from the group consisting of graphite and metallic materials capable of withstanding contact with the molten metal poured into the mold without the liner 38 being melted or fused therewith.

We prefer that the anti-wetting coating 42 is zirconium oxide which is flame sprayed onto a cold liner surface at an application temperature of approximately 500° F. Flame sprayed zirconium oxide is preferred because it has a melting point of approximately 3200° F. Also, the zirconium oxide has relatively low thermal conductivity and therefore further increases the insulation value or "R-value" of the liner 38. Preferably, the zirconium oxide coatings 42 have a thickness of no more than 0.02 inches, although it is merely required that the coatings 42 have a thickness sufficient to provide protection from oxidation.

We have found that the zirconium oxide coatings 42 act as an anti-wetting agent which prevents the metal in the sinkhead from melting onto or fusing with the liner 38. Also, the coating 42 on outer surface 44 prevents spalling which can occur upon repeated thermal cycling causing the condensation of moisture. Therefore, the coatings 42 on the surfaces 40 and 44 provide a very efficient means for increasing the thermal insulation capacity of the liner 38, while preventing the molten metal from fusing to the liner 38 and also preventing spalling which could cause premature failure of the hot top H. It may be of advantage to use, by way of zirconium oxide, cubic stabilized zirconium oxide, i.e., a solid solution of $ZrO_2$ and at least one appropriate stabilizing oxide such as CaO or a rare earth oxide such as $La_2O_3$ or $Yb_2O_3$. For instance, one may use a solid solution having the following molar composition: $ZrO_2$-85%, CaO-15%. This composition avoids the risk of cracks occurring in the zirconium oxide coating layer due to the discontinuity of thermal expansion resulting from the phase transition at 1000° C. between the monoclinic phase existing below that temperature and the cubic phase which exists above that temperature.

While we prefer the use of flame sprayed zirconium oxide, other refractory compositions may be used, such as aluminum oxide, chromium oxide, titanium oxide, magnesium oxide, boron nitride, nickel silicide, aluminum silicide, hafnium silicide, as well as combinations thereof.

Radially extending flange 46 extends outwardly from the lower portion of liner 38 a distance of approximately two inches. Downwardly extending flange member 48 extends from liner 38 generally perpendicular to flange 46 and forms a notch 50 therewith in which seal 52 is positioned by clips 54. The flanges 48 and 46 provide a barrier preventing leakage of molten metal along surface 36 which could solidify with and secure the hot top H to the mold 12. We have found that the flange 46 should have a length of approximately two inches in order to prevent the well known Coanda effect from occurring. Preferably the seal 52 is comprised of a rope-like refractory material. A similar flange 56 extends radially outwardly from the upper end of liner 38 parallel to flange 46 and receives, a similar refractory seal 58. Clips 60, which are similar to clips 54, secure thermal seal 58 to flange 56.

It can be noted that seal 52 bears upon and rests on seating surface 16 of mold 12 and prevents the flanges 46 and 48 from contacting mold 12. As a consequence, liner 38 is not engaged with the mold 12 and cannot conduct heat thereto. The seal 52, because of its refractory composition, prevents heat conduction from the liner 38 to the mold 12 as would occur without this thermal isolation barrier. Similarly, seal 58 engages surface 62 of leg 36 and likewise thermally isolates the liner 38 from the cap 30, and hence from shell 10. The thermal seals 58 and 52, therefore, thermally isolate the liner 38 from the mold 12 and the shell 10 and prevent heat conduction away from the liner 38 which could cause premature or rapid chilling of the molten metal in the sinkhead defined by the liner 38. The seal 52 furthermore acts as a barrier to the passage of molten metal, which barrier, when combined with the flange 46, effectively serves to maintain the molten metal in the sinkhead.

Refractory insulating composition 64 is, preferably, sandwiched between liner 38 and the inner wall defined by opening 18. The refractory insulation 64 serves to further increase the insulation capacity of the hot top H and prevents heat transmission by radiation, convection or conduction. The refractory insulation 64 is, preferably, a loose-type compressible composition, such as Kaowool®, so that the liner 38 is free to slide in the opening 18. We understand that Kaowool consists of ceramic fibers derived from kaolin, i.e. a natural hydrated alumino-silicate (China clay) by a thermal treatment with fusion at approximately 1700° C. and removal of its free and combined water. Kaowool fibers are spun from the melt of kaolin, and their composition is approximately 46% $Al_2O_3$ and 54% $SiO_2$ (by weight). While we prefer to use thermal insulating composition 64, such use may not always be required. The air gap between the liner 38 and the shell 10 may be sufficient insulation medium in some cases.

Figure 2:
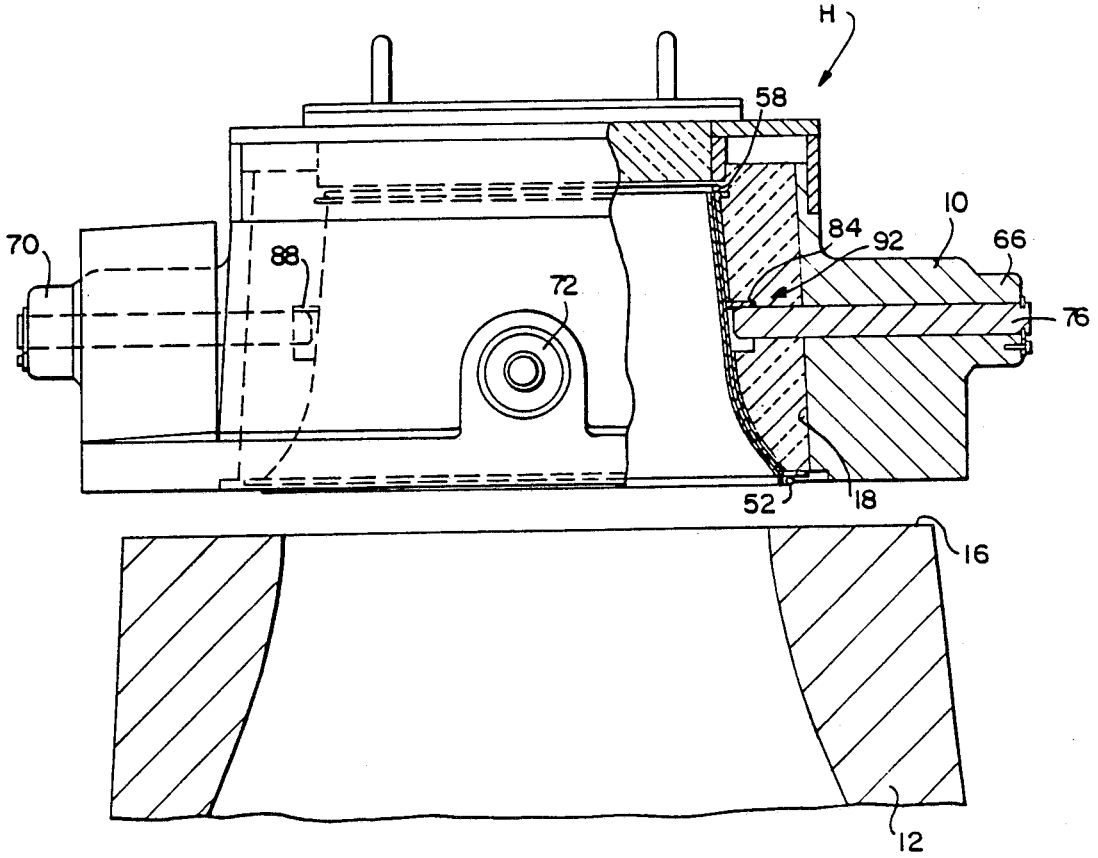
FIG. 2 is a side elevational view similar to FIG. 1 with the hot top lifted from the mold.
Figure 3:
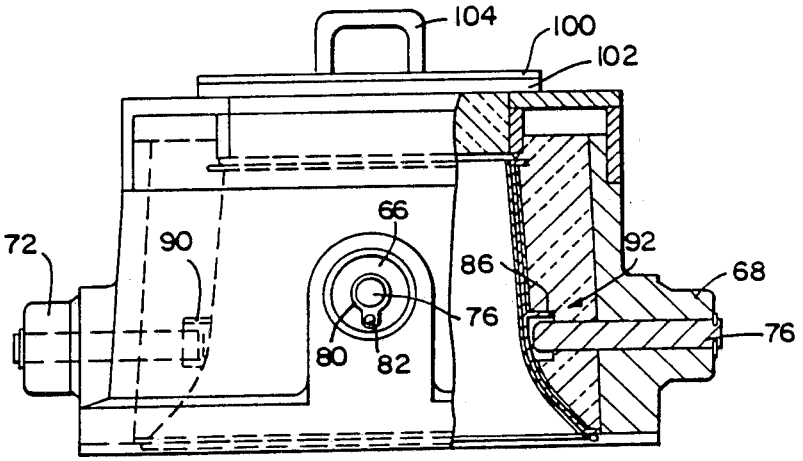
FIG. 3 is a side elevational view of the hot top of FIG. 1.

As best shown in FIG. 4, shell 10 has trunnions 66, 68, 70 and 72 extending from opposite sides thereof in equiangular relation. The shell 10, as illustrated in FIG. 4, has a configuration conforming generally to that of the underlying mold 12 and need not be rectangular as illustrated. The trunnions 66, 68, 70 and 72 are disposed in cooperating lifting pairs and permit the hot H to be lifted from the mold 12 by cranes or the like, in a manner well known in the art. The trunnions 66 and 70 are axially aligned in a first pair, while the trunnions 68 and 72 are aligned in a second pair. As shown in FIGS. 2 and 3, the trunnions 66 and 70 are spaced a distance above seal 52 which exceeds the distance the trunnions 68 and 72 are spaced from the seal 52.

Each of the trunnions 66, 68, 70 and 72 has a bore therein. Only the bore and cooperating assemblies of the trunnion 66 will be further discussed, although those skilled in the art will realize that the trunnions 68, 70 and 72 have corresponding assemblies for like reasons.

Trunnion 66 has a bore 74 extending therethrough and in which pin 76 is received. Pin 76 has an annular recess 78 to which pin retainer 80 is mounted. Pin retainer 80 is secured to trunnion 66 by bolt 82 and thereby effectively secures the pin 76 within the bore 74.

Semicircular lugs 84, 86, 88 and 90 extend radially outwardly from liner 38 and are disposed equiangularly about liner 38. Each of the lugs 84, 86, 88 and 90 is positioned in angular alignment with one of the pins 66, 68, 70 and 72. It can be noted in FIGS. 2 and 3 that the terminal end 92 of each pin 76 is received in its cooperating associated lug but is spaced radially away from liner 38. Naturally, the pin 76 of each of the trunnions is similarly aligned with its cooperating lug for reasons to be explained. The pins 76 and the lugs 84, 86, 88 and 90 are each comprised of, preferably, steel or similar heat conductive material.

FIG. 5 discloses the opening 94 at the upper end of liner 38 through which the molten metal is poured. Also to be noted in FIG. 5 is the gap 96 between the flange 46 and the notch 22 of shell 10. It can be seen, therefore, that the liner 38, including its flange 46, never comes into direct contact with shell 10 so that heat in the sinkhead is not conducted away from the liner 38.

FIGS. 1 and 4 disclose the thermal cover 98 which closes opening 94. Plate cover assembly 98 includes plates 100 and 102 which are secured together. Handles 104 extend from plate 100 while insulating refractory composition 106 is secured to and extends from plate 102 into opening 108 defined by cap 30 and terminates proximate surface 62 of cap 30 to prevent contamination of the molten metal by contact therewith. In this way, the insulation 106 fills the opening 108 and provides an insulation barrier. Preferably, plate 102 is a board material comprised of Kaowool®, or similar insulating material. In this way, heat conduction from the metal in the sinkhead to the cap 30 or outwardly through opening 94 is substantially eliminated.

FIG. 2 illustrates the hot hot H as it is being set on the mold 12 by a crane or the like (omitted for clarity). It can be noted in FIG. 2 that the terminal end 92 of each pin 76 of trunnions 66 and 70 is engaged with its associated lug 84 or 88. Although not illustrated, those skilled in the art will understand that the lugs 86 and 90 of the trunnions 68 and 72 are likewise engaged with their respective pins 76. Because of the engagement of the pins with the lugs, the liner is prevented from falling from the hot top H and may only move a limited distance within the opening 18, the movement thereof being of limited amplitude as established by the distance separating the pins from the lugs. It can be noted, however, that the seal 58 has moved out of engagement with the surface 62 of the leg 36. In other words, the liner 38 has slid axially downwardly with limited amplitude, only to be caught on or arrested by the pins 76 which are received by the lugs 84, 86, 88 and 90. The pins 76 and the lugs 84, 86, 88 and 90 therefore provide a retainer system which permits the liner 38 to move axially in the opening 18 with a defined limited amplitude. Those skilled in the art will realize that the pins 76 could extend from liner 38 and the lugs from the shell 10 to like effect.

FIGS. 1 and 3 illustrate the hot top H positioned atop the mold 12 such that the lower surface 24 of shell 10 rests upon seating surface 16. In this position, it can be seen that the seal 52 rests on and is engaged with the surface 16 so that the flanges 46 and 48 do not come into contact with the seating surface 16, as previously explained. Likewise, the seal 58 engages the surface 62 of leg 36 because of the movement of shell 10 relative to liner 38 and thereby thermally isolates the flange 56 from the cap 30. Also to be noted in FIGS. 1 and 3 is the disengagement of the terminal end 92 of each of the pins 76 from the associated lug 84, 86, 88 and 90. This disengagement is due to the liner 38 being moved relative to shell 10 axially upwardly by the engagement of the seal 52 with the seating surface 16. The centers of the lugs are spaced a greater distance from seal 52 as compared with pins 76 so that the lugs 84, 86, 88 and 90 move out of engagement with the cooperating pins 76. Flange 46 is disposed below surface 24 when the hot top H is lifted from mold 12, as shown in FIG. 2, so that engagement of seal 52 with surface 16 prevents further movement of liner 38 while permitting shell 10 to continue to move until surface 24 seats on surface 16. Therefore, relative movement between liner 38 and shell 10 occurs. Loss of engagement means that the pins 76 are not able to conduct heat from the liner 38 to the shell 10. Any heat loss through the pins 76, as would be caused by convection or radiation, is minimal and can be eliminated by either coating the pins 76 with an insulating composition or by manufacturing the pins 76 themselves from an insulating material.

We have found that the liner 38, inclusive of its coatings 42 and seals 52 and 58, has a weight of approximately 35 pounds. For this reason, the shell 10 should be of fairly substantial weight in order to resist the lift created by the rising steel during the filling of the mold 12. The lightweight liner 38 is advantageous, however, because very little mass is available for being heated by the molten metal in the sinkhead. Therefore, less energy is drained from the sinkhead for heating the liner 38 and the chilling effect is therefore minimized. Likewise, because of the thermal seals 52 and 58, the mold 12 and the shell 10 do not act as radiators and heat is not drained away thereby.

We have found that the thickness of the liner 38 should be proportional to the free energy available in the sinkhead. The free energy represents the total energy in the sinkhead less the energy required to heat the liner 38, with the heat of fusion being disregarded. Therefore, we wish to maximize the free energy by seeing to it that the energy required to heat the liner 38 is minimized. Minimization of the energy required to heat the liner 38 assures that more energy remains in the sinkhead so that the temperature of the metal in the sinkhead does not decrease by an amount sufficient to cause premature solidification. Because the metal remains molten, it is therefore available for preventing pipe formation as the metal in the mold 12 cools.

We consider the free energy to be the energy available above the latent heat of fusion. Those skilled in the art will understand that the free energy of the metal in the sinkhead is proportional, therefore, to the temperature difference between the pour temperature and the solidification temperature. This may be mathematically represented as:

$$\Delta H1 = mc_p(T_p - T_s), \quad (1)$$

wherein

H1=energy in the sinkhead,
m=mass,
cp=specific heat
Tp=the pouring temperature,
Ts=solidification temperature.

Similarly, the energy required to heat the liner can be expressed as:

$$\Delta H2 = mc_p(Tf - Ta), \quad (2)$$

wherein

ΔH2=energy change to heat the liner
m=mass of the liner,
cp=the specific heat of the liner, including its coatings,
Tf=the maximum temperature which the liner attains, and
Ta=the ambient temperature of the liner.

The available free energy therefore represents ΔH1−ΔH2. Or, to express it otherwise, the available free energy is equivalent to the energy in the sinkhead less the energy required to heat the liner. Maximization of the available free energy is preferred. The less energy required for heating the liner, then more is available for maintaining the metal in the sinkhead molten.

Figure 8:
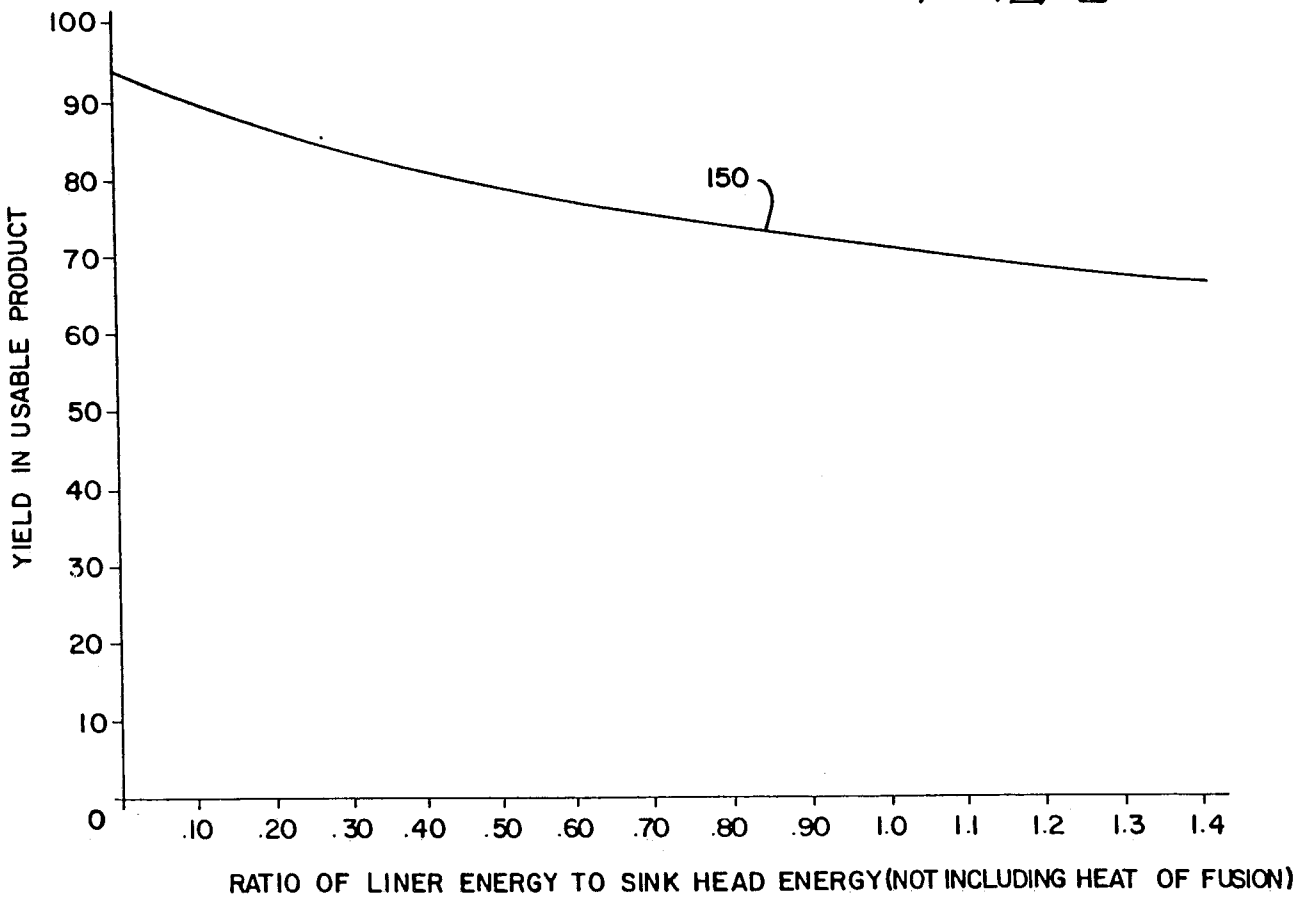

FIG. 8 discloses the empirically derived curve 150 which relates the ingot yield to the ratio of liner energy to sinkhead energy, ΔH2/ΔH1. We have found that the heat of fusion is not a necessary component of the energy calculations above. Curve 150 permits the yield of the product to be selected based upon the energy ratio. In view of the above equations, it is possible to calculate liner mass, and hence the liner dimensions, required to achieve a desired product yield. A brief review of curve 150 clearly indicates that the higher the yield desired, then the greater must be the sinkhead energy to the liner energy.

The use of curve 150 of FIG. 8 is relatively straightforward for determining the mass and hence the dimensions of the liner 38. The yield is first selected and then correlated with the ratio of liner energy to the sinkhead energy as given by curve 150. The equations 1 and 2 above are then used to calculate the ratio of the mass of the liner to the mass of the metal in the sinkhead. Those skilled in the art will appreciate that the pouring temperature and solidification temperature are generally known, as are the final temperature and the ambient temperature of the liner. The sinkhead is generally frustoconical in shape such that the mass of metal in the sinkhead can be determined by calculation of the volume. In like manner, the mass of the liner can be calculated. Preferably, computer modeling is utilized for calculating the mass and dimensions of both the sinkhead and the liner. Also, the user will frequently have already optimized the hot top configration which can then be a starting point.

FIG. 6 discloses a second embodiment of the invention. Hot top H1 rests upon ingot mold 160 which corresponds to ingot mold 12. Mold 160 has an opening 162 therein and an upper rest surface 164.

Shell 166 has an opening 168 therethrough. Shell 166 is, preferably, comprised of steel or the like and conforms to the shell 10 of hot top H 1. Shell 166 has a seating surface 170 which rests on rest surface 164 of mold 160. It can be noted that the seating surface 170 comes into intimate contact with rest surface 164 and permits heat conduction therebetween.

Shell 166 has an inwardly directed flange 172 at the lower end thereof. It can be noted that the flange 172 is outwardly disposed relative to opening 162, for reasons to be further explained. The flange 172 has an inward wall element 174 which is outwardly spaced relative to the opening 162, but inwardly spaced relative to the opening 168 in order to provide a clearance area 176.

Annular groove 178 extends around the upper end of shell 166. Leg 180 is positioned in groove 178, by welding or the like. Horizontal leg 182 extends therefrom, and downwardly directed vertical leg 184 extends from the remote end of leg 182.

Liner 186 is positioned in opening 168 and is axially movable with limited amplitude within the opening 168. Preferably, liner 186 is comprised of materials similar to that disclosed with regard to liner 38. As with liner 38, liner 186 has anti-wetting insulation coatings 188 on both surfaces thereof for similar reasons. Liner 186 has an S-shaped flange 190 comprised of horizontal member 192, vertical member 194 and horizontal member 196. It can be noted in FIG. 7 that horizontal member 192 has a length which is slightly less than the distance wall element 174 is from opening 162. Horizontal member 196 overlies flange 172 so that lifting of the shell 166 causes the member 196 to be engaged by the flange 172 and to be supported by same. Also to be noted in FIGS. 6 and 7 is the refractory seal 198 which thermally isolates the liner 186 from the ingot mold 160 and which is attached to horizontal member 192.

Those skilled in the art will understand that the flange 190 cooperates with the flange 172 in a manner similar to the pins 76 and the lugs 84, 86, 88 and 90. Lifting of the shell 166 through trunnions 200 will cause the flange 190 to engage the flange 172 such that the liner 186 is supported by the shell. Again, the shell 166 will move relative to the liner 186, at least until such time as the horizontal member 196 engages the flange 172. During resting of the hot top H1 on the mold 160, however, the seal 198 engages the rest surface 164 prior to the seating surface 170 engaging the rest surface 164. This therefore causes the flange 190 to move out of engagement with the flange 172 such that there is no thermal path between the liner 186 and the ingot mold 160 to permit the energy in the sinkhead to be conducted to the mold 160.

Horizontal top assembly 202 is an extension of liner 186 and similarly has anti-wetting insulation coatings 204 on the surfaces thereof. Preferably, top assembly 202 is comprised of the same materials of fabrication as is the liner 186 and may be integral therewith. Top assembly 202 has a terminal end 206 which defines a filling aperture for the hot top H1.

Refractory insulation 208 is disposed between the liner 186 and the opening 168 and corresponds to the refractory composition 64 of the hot hot H. Unlike the hot top H, however, there is no separate refractory rope-like seal extending around the top of the liner 186. Rather, the refractory insulation material 208 extends from above top assembly 202 continuously into the void created between the opening 168 and liner 186. It can be noted, however, that the composition 208 is disposed between the top assembly 202 and the terminal end of the leg 184 such that the top assembly 202 never is in intimate contact with the leg 184 when the hot top H1 is seated on mold 160. Therefore, the refractory insulation 208 does, indeed, thermally isolate the top of the liner 186 from the shell 166, much as the seal 58 isolates the liner 38 from the shell 10.

Pouring aperture cover 210 is positioned in the opening 212 defined by the terminal end 206. The cover 210 includes a handle 214 and an insulating block 216 which fills the aperture 212.

Those skilled in the art will understand that the flanges 172 and 190 need not be continuous around the opening 168. Rather, either or both of the flanges 172 and 190 may be discontinuous, it merely being required that the flange 190 be aligned with the flange 172 at a number of locations sufficient to support the weight of the liner assembly during lifting of the hot hot H1. It is required, however, that the seal 198 be continuous in order to prevent molten metal from filling the void created by the disengagement of the flange 190 from the flange 172. Similarly, it will be understood that the flange 190 should not have any breaks of a length sufficient to permit molten metal to leak past the seal 198.

While this invention has been described as having a preferred design, it is understood that it is capable of further modifications, uses and/or adaptations of the invention following in general the principle of the invention and including such departures from the present disclosure as come within known or customary practice in the art to which the invention pertains, and as may be applied to the central features hereinbefore set forth, and fall within the scope of the invention of the limits of the appended claims.

What we claim is:

1. The method of assembling a hot top, comprising the steps of:
(a) selecting the volume of a sinkhead of an ingot mold;
(b) determining the mass, specific heat, and pouring and solidification temperatures of a metal which will fill the mold and the sinkhead;
(c) calculating the free energy of the metal which will fill the sinkhead by assuming the dimensions of a liner sized to achieve the selected sinkhead volume and calculating the maximum temperature which the liner would achieve upon the sinkhead being filled with the molten metal and determining whether the calculated temperture exceeds the melting point of the liner;
(d) maximizing the free energy by repeating step c until the mass of the liner is minimized at a calculated temperature less than the melting point of the liner;
(e) forming a liner having dimensions corresponding to those of the calculated minimum mass liner; and,
(f) inserting the liner into a surrounding support structure which will rest on the mold in order to position the liner.

2. The method of claim 1, including the step of:
(a) forming the liner from a material selected from the group consisting of stainless steel, low carbon steel, pig iron, chromium, titanium, zirconium, boron, hafnium, columbium, molybdenum, tantalum, tungsten, graphite, carbon-carbon composites and combinations thereof.

3. The method of claim 1, including the step of:
(a) sandwiching an insulative material between the liner and the support structure.

4. The method of claim 1, including the steps of:
(a) providing a first insulation means extending around an upper end portion of the liner engageable with the support structure for preventing heat transfer therebetween; and,
(b) providing second insulation means extending around a lower end portion of the liner engageable with the mold for preventing heat transfer therebetween.

5. The method of claim 1, including the step of:
(a) coating the liner with an insulative anti-wetting agent.

6. The method of claim 5, wherein the
insulative anti-wetting agent is selected from the group consisting of zirconium oxide, aluminum oxide, chromium oxide, titanium oxide, magnesium oxide, boron nitride, nickel silicide, aluminum silicide, hafnium silicide and combinations thereof.

7. The method of claim 1, including the step of:
(a) forming the liner into an open ended frustoconical configuration;
(b) providing first means extending radially outwardly from the liner;
(c) providing second means extending inwardly from the support structure so that the first and second means cooperate for preventing the liner from falling from the support structure and for preventing heat transfer between the liner and the support structure when the liner is resting on the mold.

8. The method of claim 7, including the steps of:
(a) providing the first means as pins; and,
(b) providing the second means as lugs selectively engageable with the pins so that the liner may move within the support structure with a defined amplitude as the support structure is moved.

9. The method of claim 7, including the step of:
(a) providing an insulated cover assembly for closing the open upper end of the liner so that heat loss is minimized.

10. The method of controlling the chilling of a sinkhead, comprising the steps of:
(a) providing an ingot mold having an upper rest surface;
(b) determining the volume of a sinkhead sufficient to prevent the formation of voids in a metal solidified in the ingot mold;
(c) determining the mass, specific heat, and pouring and solidification temperatures of the metal which will fill the mold and the sinkhead;
(d) calculating the free energy of the metal which will fill the sinkhead by sizing a liner to achieve the selected sinkhead volume and calculating the maximum temperature which the liner would achieve upon the sinkhead being filled with molten metal and determining whether the calculated temperature exceeds the melting point of the liner;

(e) maximizing the free energy by repeating step d until the mass of the liner is minimized at a calculated temperature less than the melting point of the liner, (f) forming a liner having dimensions corresponding to those of the calculated minimum mass liner;

(g) inserting the liner into a support structure;

(h) positioning the support structure and the liner on the rest surface;

(i) filling the mold and sinkhead with the molten metal; and, (j) covering the support structure and allowing the metal to chill.

11. The method of claim 10, including the steps of:

(a) sandwiching first insulation means between the liner and the support structure;

(b) providing second insulation means extending around an upper end portion of the liner for engagement with the support structure; and, (c) providing third insulation means extending around a lower end portion of the liner for engagement with the rest surface.

12. The method of claim 10, including the step of:

(a) forming the liner from a material selected from the group consisting of stainless steel, low carbon steel, pig iron, chromium, titanium, zirconium, boron, hafnium, columbium, molybdenum, tantalum, tungsten, graphite, carbon-carbon composites and combinations thereof.

13. The method of claim 10, including the step of:

(a) coating the liner with an insulative anti-wetting agent selected from the group consisting of zirconium oxide, aluminum oxide, chromium oxide, titanium oxide, magnesium oxide, boron nitride, nickel silicide, aluminum silicide, hafnium silicide and combinations thereof.

14. The method of claim 10, including the steps of:

(a) forming the liner with first support means extending outwardly therefrom; and, (b) providing the support structure with second support means extending inwardly therefrom, said first and second support means being selectively engageable and disengageable in order to permit the support structure and liner to be moved and for preventing heat transfer between the liner and the support structure.

15. The method of claim 14, including the steps of:

(a) forming the first support means as pins; and, (b) providing the second support means as downwardly opening lugs so that the liner will engage the lugs when the support structure is raised and will disengage from the lugs when the support structure is disposed on the rest surface.

16. The method of claim 14, including the steps of:

(a) forming the liner into an open ended frustoconical configuration; and, (b) forming the first support means at equal angular positions about the liner.

17. The method of sizing a hot top liner, comprising the steps of:

(a) selecting the volume of a sinkhead of an ingot mold;

(b) determining the mass, specific heat, and pouring and solidification temperatures of a metal which will fill the mold and the sinkhead;

(c) calculating the free energy of the metal which will fill the sinkhead by sizing a liner to achieve the selected sinkhead volume and calculating the maximum temperature which the liner would achieve upon the sinkhead being filled with molten metal and determining whether the calculated temperature exceeds the melting point of the liner; and (d) maximizing the free energy by repeating step c until the mass of the liner is minimized at a calculated temperature less than the melting point of the liner.

18. The method of claim 17, including the step of:

(a) calculating the maximum temperature for a liner formed from a material selected from the group consisting of stainless steel, low carbon steel, iron, chromium, titanium, zirconium, boron, hafnium, columbium, molybdenum, tantalum, tungsten, graphite, carbon-carbon composites and combinations thereof.

19. The method of claim 17, including the step of:

(a) calculating the free energy as the total energy in the sinkhead less the energy required to heat the liner with the heat of fusion disregarded.

* * * * *